US006179234B1

(12) United States Patent
Marshall et al.

(10) Patent No.: US 6,179,234 B1
(45) Date of Patent: Jan. 30, 2001

(54) IMPELLER MOUNTING SYSTEM FOR CENTRIFUGAL IMPACT CRUSHER

(75) Inventors: James R. Marshall, Beaverton, OR (US); Ronald J. Berg, Brush Prarie; R. Scott McFarland, Vancouver, both of WA (US)

(73) Assignee: Clyde Corporation, Vancouver, WA (US)

( * ) Notice: Under 35 U.S.C. 154(b), the term of this patent shall be extended for 0 days.

(21) Appl. No.: 09/383,043

(22) Filed: Aug. 25, 1999

(51) Int. Cl.[7] ..... B02C 19/00
(52) U.S. Cl. ..... 241/275
(58) Field of Search ..... 241/275

(56) References Cited

U.S. PATENT DOCUMENTS 3,474,974 10/1969 Wood ..... 241/275
4,659,026 4/1987 Krause et al. ..... 241/275
5,137,220 8/1992 Rose et al. ..... 241/275

*Primary Examiner*—Mark Rosenbaum
(74) *Attorney, Agent, or Firm*—Chernoff, Vilhauer, McClung & Stenzel, LLP

(57) ABSTRACT

A system for mounting material directing impellers to the table of a centrifugal impact crusher includes an upstanding mounting plate having a slot extending through it which opens out of its top surface. An impeller has a rearwardly facing stob extending from it which slidably fits within the slot. A nub, which does not fit through the slot, is attached to the extremity of the stob and the stob is sized such that the nub and the rear surface of the impeller interact with the mounting plate to prevent the impeller from moving relative to the mounting plate in either circumferential direction. The sides of the slot are angled radially outwardly as they extend downwardly toward the table.

4 Claims, 3 Drawing Sheets

IMPELLER MOUNTING SYSTEM FOR CENTRIFUGAL IMPACT CRUSHER

BACKGROUND AND SUMMARY OF THE INVENTION

The subject invention relates to an apparatus for mounting impellers on rotatable tables in centrifugal impact crushers, and in particular to such an apparatus which does not use mechanical fasteners to secure the impellers to the table.

Centrifugal impact crushers deposit the material being crushed on to a rotating horizontal table. Centrifugal force throws the material radially off of the table against anvils which causes the material to be fractured. In order to direct the material so that it leaves the table with the proper projection to maximize fracture when it hits the anvils, impellers are placed at spaced intervals on the table. Due to the severe forces and shock loading that these impellers are subject to they typically are bolted or pinned to mounting brackets that are attached to the table. However, the bolt heads or pins become damaged by being impacted by the material being crushed and the material cakes around the bolt heads or pins, both of which makes it difficult to remove the bolts or pins when it is necessary to replace a worn impeller. As a result, it is desirable to secure the impellers to the table without the need for bolts or similar mechanical fasteners. This must be accomplished in a way that rigidly holds the impellers in place, however, in spite of the severe forces that tend to knock them loose.

While systems for securing impellers to the table without mechanical fasteners are known, these systems do not provide both the necessary rigidity and ease of removal of the impeller for replacement Parker, U.S. Pat. No. 3,540,667, discloses an impeller that has a hook along its inner edge that fits behind an inwardly protruding ledge in-the mounting bracket. While this system certainly provides for easy replacement of the impellers, the impellers can become displaced in use. Wood, U.S. Pat. No. 3,474,974, also discloses an impeller which is attached to the mounting bracket by means of a hook. Unlike Parker, however, Wood mechanically secures the hook to the mounting bracket.

It is common in centrifugal impact crushers to mount the anvils to their mounting brackets merely by inserting a projecting tab with an enlarged head at its end into a slot in a mounting bracket. Such an arrangement is shown in Rose, et al., U.S. Pat. No. 5,137,220, Krause, et al., U.S. Pat. No. 4,659,026 and Wood, U.S. Pat. No. 3,474,974. However, unlike impellers, anvils are not subject to centrifugal force which tends to lift them out of the slots, and the weight of the anvils will hold them in place against any lifting force caused by the impact of the material being crushed.

The subject invention overcomes the limitations and short comings of the prior art impeller mounting systems. A preferred embodiment of the invention provides a series of mounting plates which are attached to the crusher table. Each mounting plate has a slot which extends between its front and rear surfaces and opens out of its top surface. An impeller has a stob projecting from its rear or mounting face which slidably fits within the slot. A nub mounted on the extremity of the stob is configured so that it will not fit through the slot. The stob and nub are arranged to interact with the mounting bracket to prevent movement of the impeller with respect to the mounting bracket in either circumferential direction. The slot has opposed sides which are angled radially outwardly as they extend toward the table. Thus, centrifugal force will not lift the stob out of the slot as the table is rotated. -The foregoing and other objectives, features, and advantages of the invention will be more readily understood upon consideration of the following detailed description of the invention, taken in conjunction with the accompanying drawings.

DETAILED DESCRIPTION OF A PREFERRED EMBODIMENT

Figure 1:
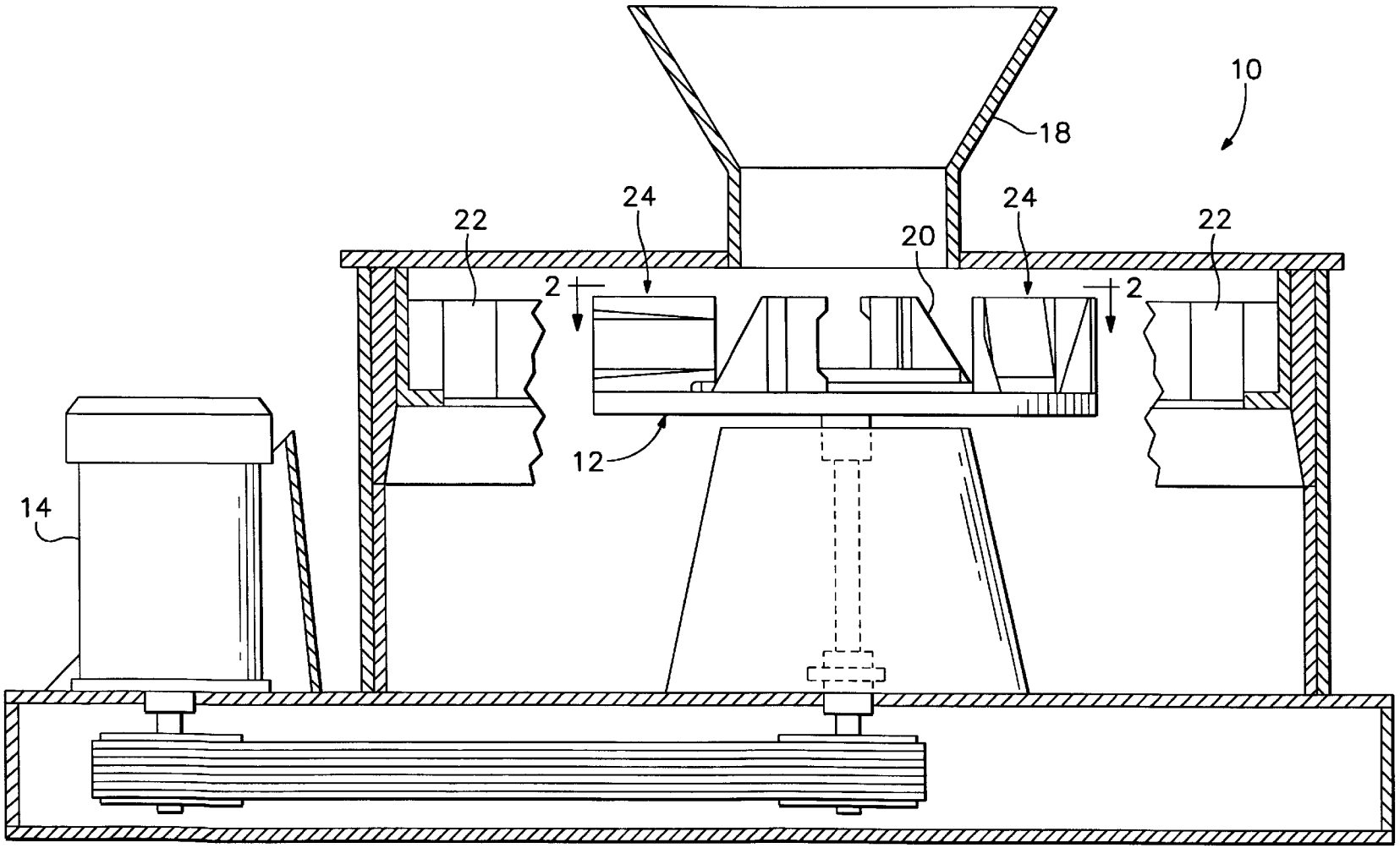
FIG. 1 is a side elevation view, in cross section and partially broken away, of a centrifugal impact crusher embodying the anvil mounting system of the subject invention.
Figure 2:
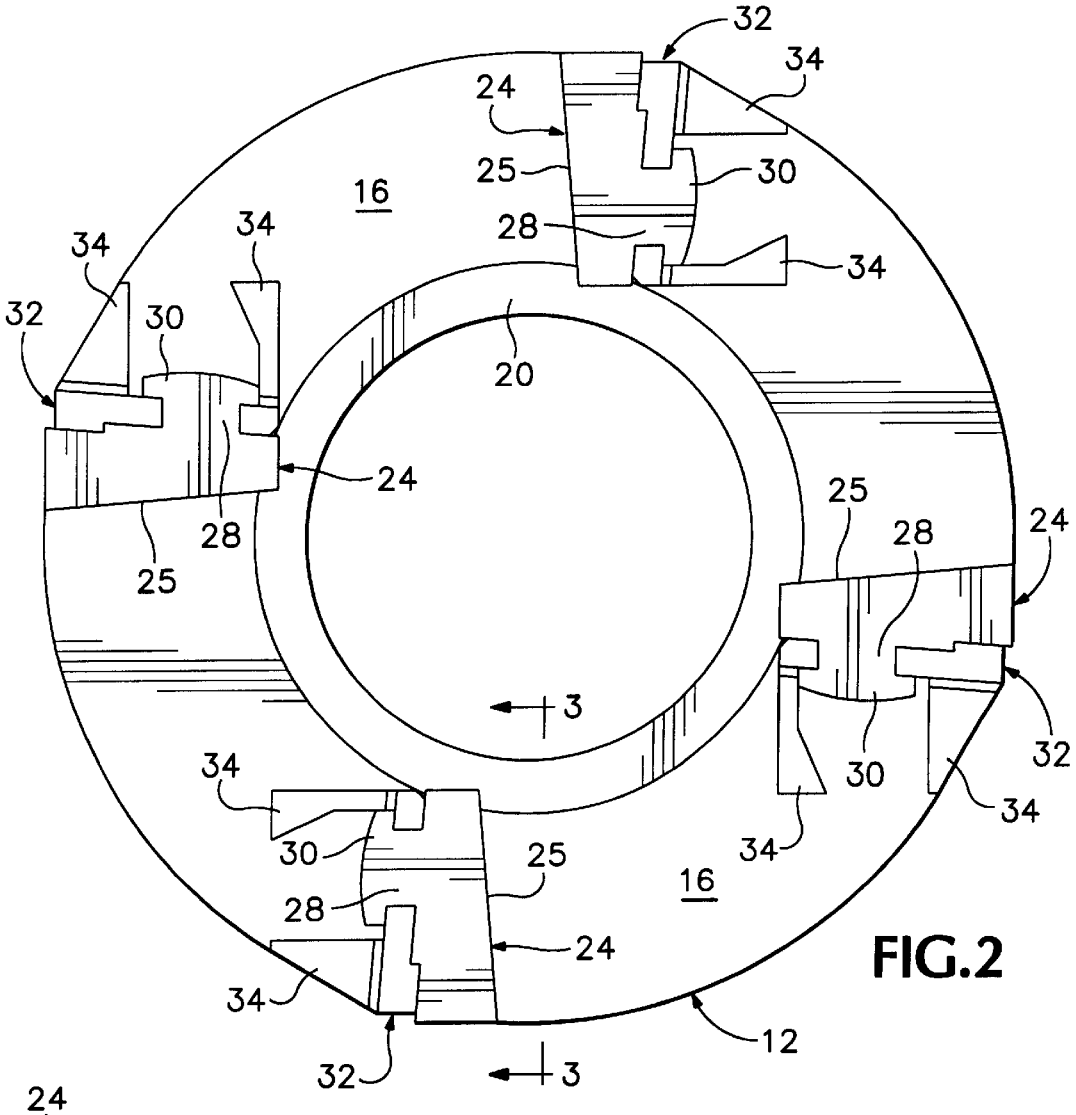
FIG. 2 is a cross sectional view taken on the line 2—2 of FIG. 1.

Referring to FIGS. 1 and 2 of the drawings, a centrifugal impact crusher 10 includes a table 12 that is rotated about a central axis by a motor 14. The flat horizontal top surface 16 of the table receives material to be crushed through a feed chute 18. A feed cone 20, located at the center of the table, distributes the material evenly onto the outer portion of the table. Centrifugal force caused by the rotation of the table causes the material to be thrown off of the table where it strikes anvils 22 located outside of the periphery of the table. When the material strikes the anvils it is fractured and the fractured material drops to the floor of the crusher where it can be removed. In order to cause the material to be thrown radially off of the table, impellers 24 are placed at spaced apart intervals on the top surface of the table.

Figure 3:
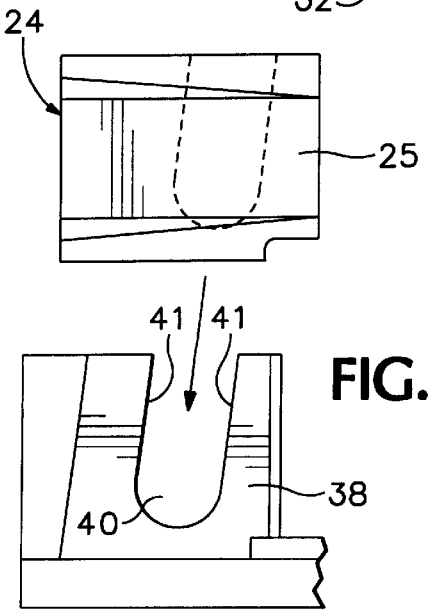
FIG. 3 is an exploded view taken on the line 3—3 of FIG. 2.
Figure 4:
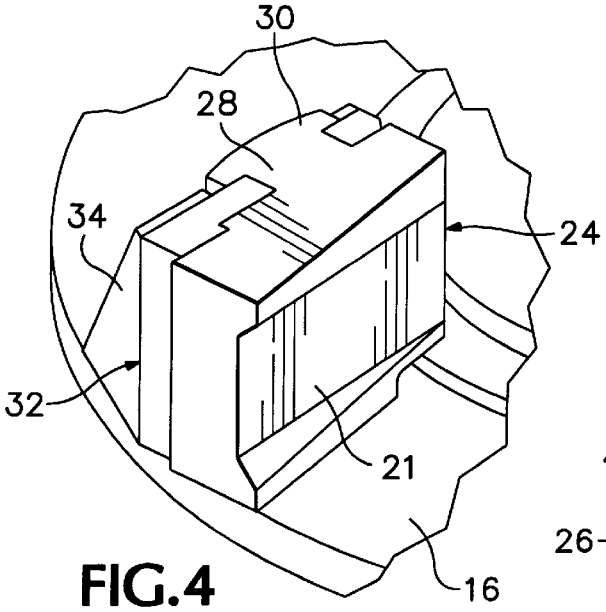
FIGS. 4 and 5 are detailed views showing how the components of the mounting system are assembled.
Figure 5:
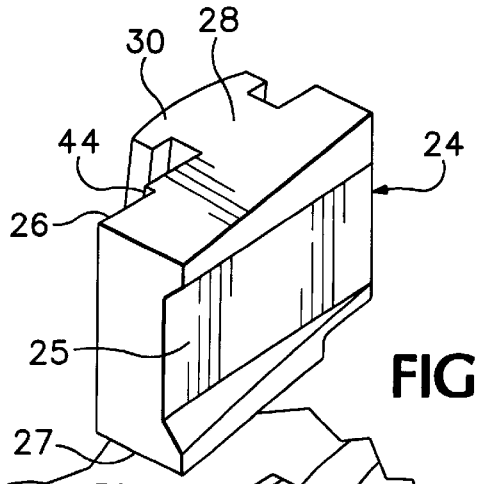
Figure 6:
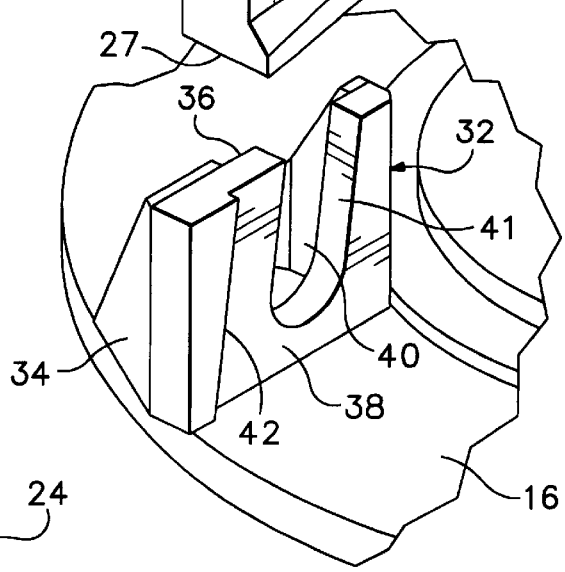
FIG. 6 is a perspective view of an alternate embodiment of one of the impellers.
Figure 6:
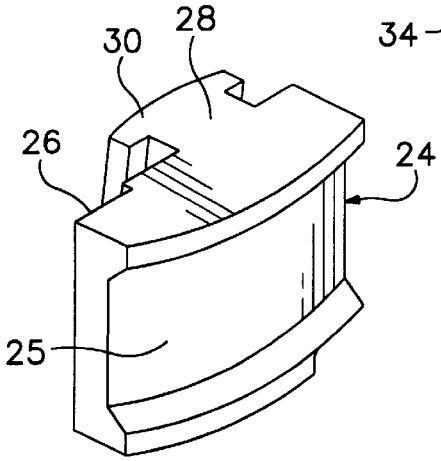

Referring now also to FIGS. 3 through 5, the impellers are mounted on the table in a manner such that they are held rigid with respect to the table but still can be easily removed. The impellers are quite massive to withstand the constant abrasion caused by the material being crushed striking them. Each impeller includes an impact face 25 which the material strikes. This face can be flat, FIGS. 3 through 5, curved concave out, FIG. 6 or any other shape which provides the desired wear characteristics and directs the material in the desired fashion. The opposite side of the impeller contains a mounting face 26, which will be explained later in more detail. The bottom face 27 of the impeller is generally flat since it rests on the table 16, although in the embodiment shown in the drawings the inside edge of the bottom is stepped up to fit over the edge of the feed cone 20. Projecting from the mounting face 26 is a stob 28, and mounted at the extremity of the stob is a nub 30.

Each impeller is attached to a mounting plate 32. In the embodiment illustrated the mounting plate is generally rectangular. The mounting plate has a bottom surface (not shown) which is attached to the top surface 16 of the table 12. In the embodiment illustrated the mounting plate has a triangular brace 34 at each end on its rear surface 36. Its rear surface and front surface 38 are generally planer and parallel to one another. A slot 40 extends medially through the mounting plate. The slot opens out of the top of the mounting plate and is dimensioned to permit the stob 28 on the impeller to slidably fit in it with the bottom face of the impeller resting on the top surface 16 of the table 12, FIGS.

4 and 5. A tight fit is provided between the stob and the sides 41 of the slot 40. Thus, the stob interacts with the sides to prevent radial movement of the impeller relative to the mounting plate.

The length of the stob is such that when the impeller is mounted on the mounting plate the nub 3 bears against the rear surface of the mounting plate and the mounting plate face of the impeller bears against the front surface of the mounting plate. Thus, the mounting plate prevents circumferential movement of the impeller also. While the embodiment illustrated shows the nub and mounting face of the impeller being in direct contact with the respective faces of the mounting plate, this is not necessary. Intermediate elements or shims could be placed between these elements. All that is necessary is that when the impeller is in place on the mounting plate the mounting plate interacts with the nub and mounting surface to prevent the impeller from moving in either circumferential direction with respect to the mounting plate.

In order to prevent centrifugal force from lifting the impeller off of the mounting plate, the sides 41 of each slot 40 angle radially outwardly as they extend toward the bottom of the slot. Since centrifugal force urges the impeller outwardly, this angle holds the stob in the slot.

In the embodiment illustrated the front surface 38 of the mounting plate 32 and the mounting face 26 of the impeller 24 are stepped to provide edges 42 and 44 respectively. These edges interact to absorb some of the radial force between the impeller and mounting plate, which decreases the chance that the stob will break. The edges 42 and 44 need to have the same angle as the sides 41 of the slots 40.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An apparatus for mounting material directing impellers to a rotating table of a centrifugal impact rock crusher comprising:

(a) a mounting plate fixedly attached to a crusher table, said mounting plate having a top surface which is separated from said table, a front surface, and a rear surface, said mounting plate having a predetermined width between said front and rear surfaces;

(b) said mounting plate having a slot defined therein which extends between said front and rear surfaces and opens out of said top surface;

(c) an impeller having an impact face and a mounting face which are generally opposed to one another;

(d) a stob having a predetermined length, projecting from said mounting face of said impeller and configured to slidably fit within said slot;

(e) a nub mounted on the extremity of said stob configured not to fit through said slot;

(f) said stob and nub being configured such that when said stob is positioned within said slot said nub interacts with the rear surface of said mounting plate to prevent movement of said impeller relative to said mounting plate in a first circumferential direction and the mounting face of said impeller interacts with the front surface of said mounting plate to prevent movement of said impeller relative to said mounting plate in a second circumferential direction, wherein (g) said slot has opposed sides which are angled radially outwardly as they extend towards said table.

2. The apparatus of claim 1 wherein the front surface of said mounting plate and the mounting surface of said impeller are stepped along a generally vertical edge so that said stepped edges interfit to resist radially outward movement of said impeller relative to said mounting plate.

3. The apparatus of claim 2 wherein said stepped edges are angled radially outwardly as they extend towards said table.

4. The apparatus of claim 1 wherein the length of said stob is slightly greater than the width of said mounting plate such that when said stob is placed in said slot said nub bears against the rear surface of said mounting plate and said mounting face of said impeller bears against the front surface of said mounting plate to hold said impeller rigidly in said mounting plate.

* * * * *